US008419018B1

(12) United States Patent
Cisneros

(10) Patent No.: US 8,419,018 B1
(45) Date of Patent: Apr. 16, 2013

(54) GOLF PUTTER HAVING RELEASABLY SECURED BALLMARK AND INTEGRAL BALL RETRIEVAL APPARATUS

(76) Inventor: Raul Cisneros, Elk Grove, CA (US)

( * ) Notice: Subject to any disclaimer, the term of this patent is extended or adjusted under 35 U.S.C. 154(b) by 125 days.

(21) Appl. No.: 13/181,296

(22) Filed: Jul. 12, 2011

(51) Int. Cl.
*A63B 53/00* (2006.01)

(52) U.S. Cl.
USPC ..... 273/285; 273/286

(58) Field of Classification Search ..... 473/285, 473/286
See application file for complete search history.

(56) References Cited

U.S. PATENT DOCUMENTS 5,759,111 A * 6/1998 Clark ..... 473/285
5,779,558 A * 7/1998 Britton ..... 473/286
2002/0147055 A1* 10/2002 French ..... 473/286
2003/0104875 A1* 6/2003 Markwood ..... 473/285
2003/0195054 A1* 10/2003 Rioux ..... 473/286
2004/0092340 A1* 5/2004 Kvitek ..... 473/406

* cited by examiner

*Primary Examiner* — Michael Dennis
(74) *Attorney, Agent, or Firm* — Gulf Coast Intellectual Property Group

(57) ABSTRACT

A golf putter configured to assist a player in marking the location of a golf ball on the golf course green and further provide retrieval capabilities of the golf ball subsequent completion of play. The golf putter further includes a shaft having a head secured to one end. The head includes a bottom surface having a recess that is generally annular in shape. Disposed within the recess is an annular shaped ball marking disc. The head further includes a magnet that is slidably mounted within an internal cavity that functions to releasably secure the ball marking disc to the bottom surface of the head of the putter. The golf putter further includes a ball retrieval apparatus that is disposed within the shaft opposite the head. The ball retrieval apparatus includes a plurality of arms manufactured of a resilient metal that are operable to be extended outward from the shaft in order to assist in the retrieval of a golf ball without the user having to bend over to retrieve the golf ball.

7 Claims, 2 Drawing Sheets

GOLF PUTTER HAVING RELEASABLY SECURED BALLMARK AND INTEGRAL BALL RETRIEVAL APPARATUS

FIELD OF THE INVENTION

The present invention relates to a golf putter, more specifically but not by way of limitation, a golf putter that further includes an integrated ball marking device facilitating the marking of a position of a golf ball on a golf course green and wherein the golf putter further includes a golf ball retrieval device that is stored with the shaft of the golf putter.

BACKGROUND

Millions of individuals around the world play golf on a regular basis. The sport of golf has existed for centuries and is steeped in tradition. As is known in the art, there are many facets to the game of golf. The game of golf can be divided into generally three segments of play. The first segment consists of the initial shot on a hole, which is traditionally referred to as a tee shot. This segment usually involves the use of a specialized golf club known as a driver. The next segment of a golf game can be generally categorized as fairway play. This segment is executed utilizing numerous different types of clubs that are all within the general category of golf clubs known as irons. The last segment of play involves the play on the golf course green. Players will utilize a specialized golf club known as a putter on this portion of the golf course.

Typically, players will execute more shots per round of golf on the golf course green than any of the other two aforementioned segments. During the course of play on the green, in accordance with the rules of the game, a player will be required to mark the position of their golf ball on the green while the other player(s) execute their turn of play. Typically this is achieved by utilizing a coin or a disc that meets the size requirements of the regulations of the game. This coin or disc is often kept in the player's golf bag or in their pocket. The player typically bends down and places the ball-mark adjacent to their golf ball and subsequently removes the golf ball from the green. For many players that have medical conditions such as injured knees or back pain, this task can be quite burdensome and ultimately result in the player retiring from the game or playing the game with less frequency.

Another step in the execution of play on the golf course green is retrieving the golf ball once it has been putted into the golf cup. Golf course greens have a hole that is typically 4.25 inches in diameter and about 4 inches in depth. To complete each hole during the game, once the player has positioned the golf ball on the golf course green, the player must advance the golf ball utilizing a golf putter until it is deposited into the golf cup. Once the golf ball has been advanced into the golf cup the player is required to retrieve the golf ball. This maneuver again typically requires the player to bend so as to reach the golf ball within the golf cup. This again can cause pain or trauma to those players that are older or have medical conditions.

Accordingly, there is a need for a golf putter that has releasably secured thereto a golf ball-mark that can be positioned adjacent to the golf ball on the golf course green wherein the player can remain in an upright position. Furthermore, it is desirable to have the golf putter to further be capable of retrieving the golf ball from the golf cup once the hole has been completed.

SUMMARY OF THE INVENTION

It is the object of the present invention to provide a golf putter that further includes a golf ball-mark that is integrally formed with the head of the putter.

Another object of the present invention is to provide a golf putter that includes a golf ball retrieval device that is stored within a portion of the shaft of the putter.

A further object of the present invention is to provide a golf putter having an integrally formed ball-mark wherein the ball-mark is integrated into the bottom surface of the head of the putter.

Yet another object of the present invention is to provide a golf putter having an integrally formed ball-mark on the bottom surface of the head of the putter that is releasably secured within a recess utilizing a magnet.

An additional object of the present invention is to provide a golf putter having an integrally formed ball-mark that conforms to the regulations of the game of golf.

Still a further object of the present invention is to provide a golf putter that includes a golf ball retrieval device that is stored within the shaft proximate the grip.

Yet a further object of the present invention is to provide a golf putter that includes a golf ball retrieval device that is stored within the shaft that is extendable.

Another object of the present invention is to provide a golf putter that includes an integrated ball-mark and a ball retrieval apparatus wherein the putter is manufactured such that the putter conforms to the regulations of the game of golf.

An additional object of the present invention is to provide a golf putter that includes an integrated ball-mark and a golf ball retrieval apparatus that is inexpensive.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
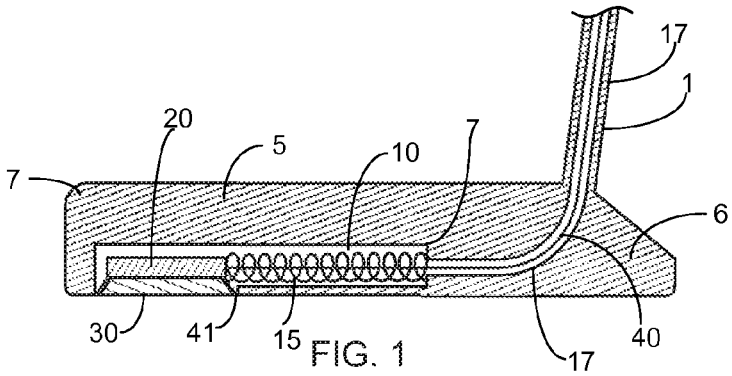
FIG. 1 is a detailed view of the head portion of the present invention.
Figure 2:
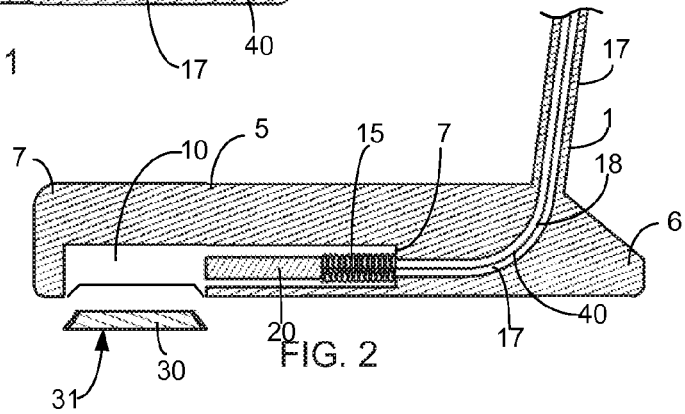
FIG. 2 is a detailed view of the shaft portion having the golf ball retrieval apparatus disposed therein.

Referring now to the drawings submitted herewith, wherein various elements depicted therein are not necessarily drawn to scale and wherein through the views and figures like elements are referenced with identical reference numerals, there is illustrated a golf putter 100 constructed according to the principles of the present invention.

Figure 6:
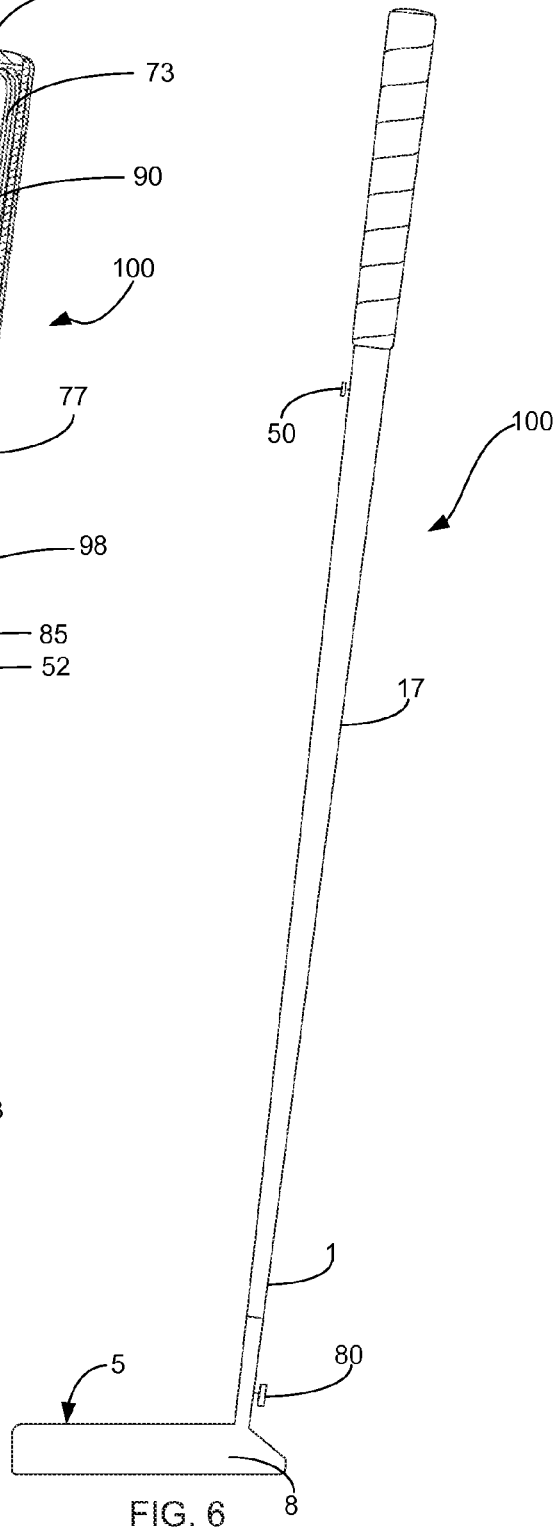
FIG. 6 is a perspective external view of the present invention.

A cross-sectional view of the head 5 of the golf putter 100 is shown in FIG. 1. The head 5 is mounted to the shaft 17 proximate end 1 utilizing suitable durable techniques. The head 5 is generally modified rectangular in shape having a first end 6 and a second end 7. The head 5 is manufactured from conventional materials such as but not limited to metal. The head 5 includes a striking surface 8, shown in FIG. 6, similar to most conventional golf putters, that is generally solid and vertical in nature when the golf putter 100 is placed on a golf course green in the proper position to strike a golf ball. While the head 5 is illustrated herein as being generally modified rectangular in shape, it is contemplated within the scope of the present invention that head 5 could be shaped in numerous different shapes. The head 5 further includes a cavity 10. The cavity 10 is generally rectangular in shape and has an interior volume 11 that functions to house the spring 15 and magnet 20. The cavity 10 is integrally formed with channel 17. The channel 17 is generally arcuate in shape having a hollow passage 18 therethrough that provides access for the control wire 40.

Removably mounted to the bottom surface 25 of the head 5 is a ball-mark 30. The ball-mark 30 is substantially rigid and generally planar in manner and is mounted within recess 28. The recess 28 is formed in the bottom surface 25 and has a sufficient depression so as to allow the lower surface 31 of the ball-mark 30 to be planarly aligned with the bottom surface 25 so as to substantially inhibit the mark 30 from interfering with the performance of the golf putter 100 when in use during the putting a golf ball on a golf course green. The ball-mark 30 has a first position and a second position. In the first position, the ball-mark 30 is stored within the recess 28 such that the lower surface 31 of the ball-mark 30 is planarly aligned with the bottom surface 25 of the head 5. The ball-mark 30 and the recess 28 are generally annular in shape and the ball-mark 30 is manufactured from a material such as but not limited to a ferromagnetic metal. While the ball-mark 30 and the recess 28 are illustrated herein as being annular in shape, it is contemplated within the scope of the present invention that the ball-mark 30 and the recess 28 could be manufactured/formed in numerous different shapes that are similar and mateable. In the second position, the ball-mark 30 is released from the head 5 of the golf putter 100 and is deposited onto a golf course green adjacent to the player's golf ball. The ball-mark 30 is stored in its first position utilizing the magnet 20. The magnet 20 is slidably secured within the cavity 10 utilzing suitable durable techniques. The magnet 20 is a conventional magnet and has a first position and a second position. In its first position, the magnet 20 is positioned such that the magnet 20 is substantially aligned with the recess 28. In the first position, the magnetic vector forces of the magnet 20 provide sufficient force to maintain the ball-mark 30 in its stored position within the recess 28. In its second position, the magnet 20 is slidably traversed towards end 6 such that the magnetic vector forces acting on the ball-mark 30 are reduced allowing the ball-mark 30 to be released from the recess 28 of the head 5 and be placed adjacent to a golf ball on a golf course green.

Figure 5:
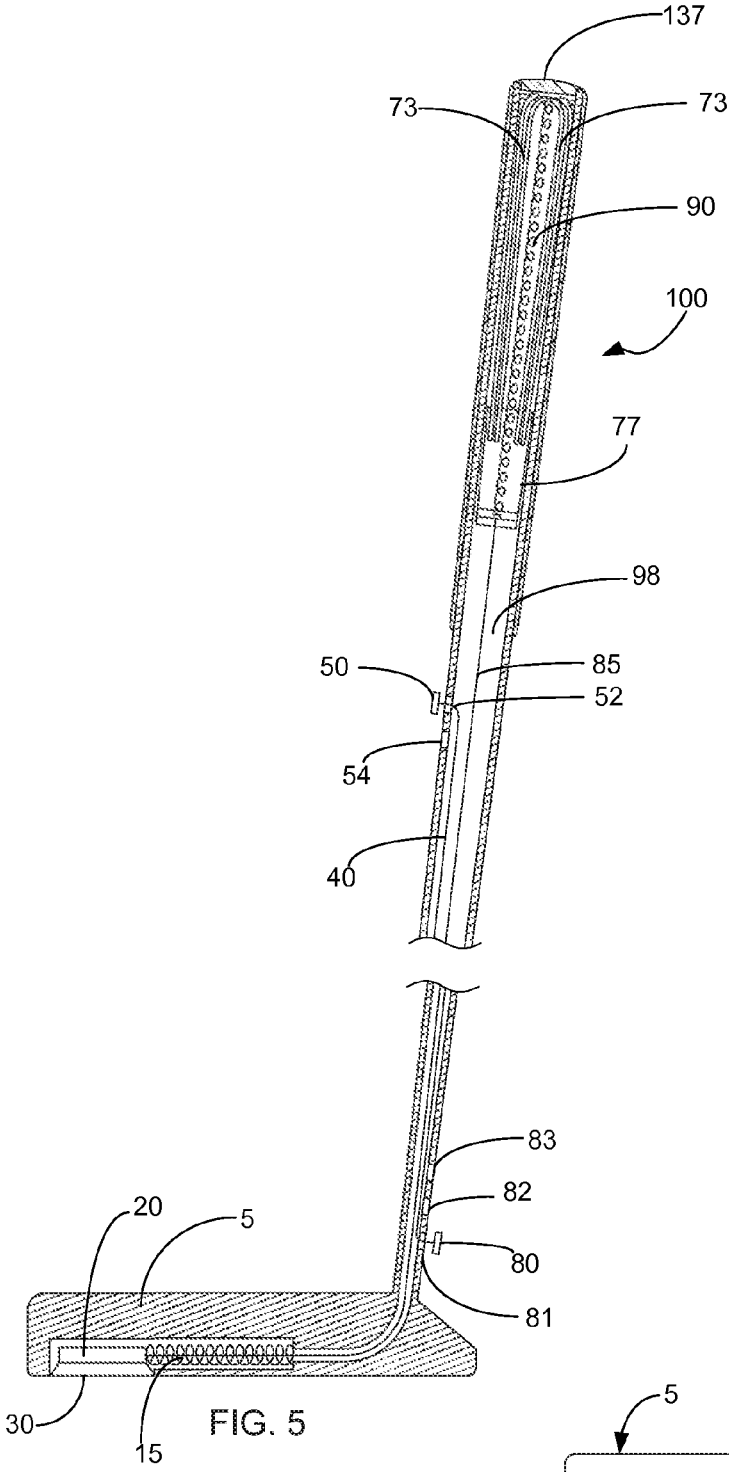
FIG. 5 is a side view of the present invention.

The magnet 20 is operably connected to control wire end 41 utilizing suitable durable methods such as but not limited to welding. The control wire end 41 is secured to the magnet 20 allowing the user to transition the magnet 20 between its first position and its second position. The control wire 40 journals through the spring 15 permitting the spring 15 to bias the magnet 20 in its first position wherein the magnet 20 is substantially aligned with the recess 28. As shown in FIG. 5, the control wire 40 has secured thereto proximate end 49 distally located from the spring 15 a keeper 50. The keeper 50 is manufactured from a suitable durable material and is secured to the control wire 40 utilizing suitable techniques. The keeper 50 is operable to maintain the end 49 of the control wire 40 in a first position or a second position utilizing the slots 52, 54. The slots 52, 54 are formed in the exterior of the shaft 17 and journal through the shaft wall 3. When the keeper 50 is placed in slot 52, tension is applied to the control wire 40 and therefore compressing the spring 15 causing the magnet 20 to slidably traverse such that the magnet 20 is moved its second position wherein the magnet 20 is no longer in general alignment with the recess 28. Once the magnet 20 has been moved to its second position, the ball-mark 30 is released from the recess 28 of the head 5.

As the keeper 50 is maintained in the slot 52, the magnet 20 will remain in its second position such that the magnet 20 is not aligned with the recess 28. While not particularly illustrated herein, it is contemplated within the scope of the present invention that the slots 52, 54 are formed such that the keeper 50 is retained therein and movable between slots 52, 54. Those skilled in the art will recognize that the slot 52 could be formed in numerous different manners and accomplish the desired functionality as described herein. When the user engages the keeper 50 and moves the keeper 50 such that the keeper 50 is releasably secured in slot 54, the force on the control wire 40 is reduced, the spring 15 then biases against the magnet 20 and the interior wall 7 of the cavity 10 so that the magnet 20 is returned to its first position such that the magnet 20 is substantially aligned with the recess 28. Subsequent the ball-mark 30 being positioned proximate the recess 28, the magnetic vector forces of the magnet 20 will secure the ball-mark 30 within the recess 28 in its stored position wherein the lower surface 31 of the ball-mark 30 is planarly aligned with the bottom surface 25 of the head 5. While in the embodiment illustrated herein, the ball-mark 30 is releasably secured in the head 5 of the golf putter 100 utilizing a magnet 20 having a control wire 40 and spring 15 operably coupled thereto, it is contemplated within the scope of the present invention that the ball-mark 30 could be releasably secured to the bottom surface 25 of the head 5 utilizing numerous other mechanical or electrical techniques. More specifically but not by way of limitation, the ball-mark 30 could be releasably secured to the head 5 utilizing an electromagnet and/or other techniques of mechanical coupling fasteners. It is also additionally contemplated within the scope of the present invention that the head 5 of the golf putter 100 is manufactured such that the weight distribution is substantially equal across the distance from first end 6 to second end 7.

Figure 3:
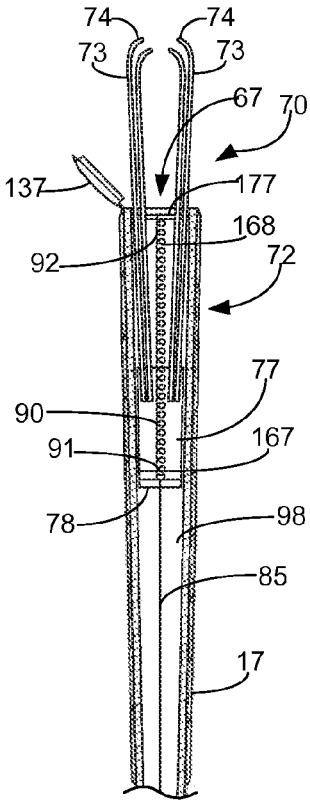
FIG. 3 is a bottom view of the head portion of the present invention.
Figure 4:
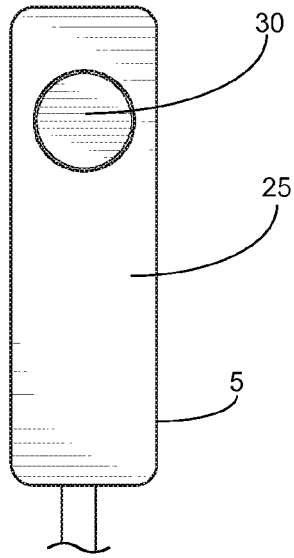
FIG. 4 is a cross-sectional view of the present invention.

Illustrated in particular in FIGS. 3 and 5, the shaft 17 has disposed therein a ball retrieval apparatus 70. The ball retrieval apparatus 70 is movably secured within the interior volume 98 of the shaft 17 proximate the grip area 72. The ball retrieval apparatus 70 includes a plurality of arms 73. The arms 73 are manufactured of a suitable durable material such as but not limited to a resilient metal. The arms 73 function to engage a golf ball once extended from the shaft 17 so as to facilitate retrieval thereof. The arms 73 further include ends 74 that are generally hook shaped so as to facilitate an increased securement of the golf ball subsequent the golf ball being releasably secured within the ball capture area 75. While the ball retrieval apparatus 70 is illustrated herein as having four arms 73, it is contemplated within the scope of the present invention that the ball retrieval apparatus 70 could utilize as few as three arms 73 or more than four arms 73.

The ball retrieval apparatus 70 further includes member 77 that has secured thereto control wire 85. The arms 73 are secured at member 77. The member 77 is shaped so as to slidably mount within the shaft 17 utilizing suitable techniques. The member 77 includes bottom 78 that is substantially rigid. The bottom 78 is operably coupled with end 167 of the spring 90. The second end 168 of the spring 90 is secured to pin 177 utilizing suitable durable techniques. The pin 177 is mounted diametrically across the shaft 17 and is positioned so as not to engage with the arms 73 as the ball retrieval apparatus 70 during operation. The pin 177 is constructed of a suitable durable material such as but not limited to metal.

As discussed further herein, when the control wire 85 is moved to slot 81 or 82, the spring 90 will be in an extended position such that the member 77 will be moved towards the head 5 and the ball retrieval apparatus 70 will be either partially or completely disposed within the shaft 17.

The wire control wire 85 is a conventional metal wire and is secured to member 77 utilizing suitable durable techniques such as but not limited to welding. The control wire 85 functions to allow the user to move member 77 so as to transition the ball retrieval apparatus 70 between a first, second and third position. The spring 90 includes a first end 91 and a second end 92. The second end 92 of the spring 90 is secured to pin 177. The control wire 85 is manufactured from a suitable durable material such as but not limited to metal. The control wire 85 extends from bottom 78 of the member 77 to the holder 80. The holder 80 is manufactured from a suitable durable material such as but not limited to metal or plastic and is secured to the control wire 85 utilizing suitable techniques. The holder 80 is movably secured to the slots 81,82,83. The slots 81,82,83 are journaled through the wall 3 of the shaft 17 and are formed such that the holder 80 is releasably secured thereto and movable between the slots 81,82, and 83.

The grip area 72 includes end 137 that is hingedly secured utilizing conventional fasteners to shaft 17. The end 137 functions to be transitioned from a first position to a second position during operation of the ball retrieval apparatus 70. The end 137 is substantially annular in shape and is hingedly secured so as to allow the end 137 to be placed in a second position wherein the end 137 is substantially removed from opening 67. End 137 in its second position is hinged away from opening 67 to allow the ball retrieval apparatus 70 to be utilized to retrieve a golf ball. As previously referenced herein, holder 80 is movably secured to slots 81,82 and 83. As holder 80 is releasably secured within slot 83, the spring 90 is compressed having little or no biasing force and the ball retrieval apparatus 70 is extended outward from within the interior volume 98. In this position a user may position the arms 73 circumferentially around a golf ball in order to be retrieved.

Subsequent the holder 80 being transitioned to slot 82 wherein the spring 90 is at least slightly extended thereby applying a downward force on the member 77, the arms 73 are refracted towards the head 5 such that the arms 73 collapse around a golf ball disposed within the ball capture area 75 and are biased sufficiently against the golf ball so as to maintain the golf ball within the ball capture area 75. In order to release the golf ball from the ball capture area 75 the holder 80 is transitioned back to slot 83 so that the arms 73 are not biased thereagainst.

Subsequent holder 80 being transitioned to slot 81, the spring 90 is substantially extended and the ball retrieval apparatus 70 is positioned such that the ends 74 of arms 73 are disposed within the shaft 17. The holder 80 is maintained in slot 81 during utilization of the golf putter 100. While a preferred embodiment of the ball retrieval apparatus 70 has been disclosed herein, it is contemplated within the scope of the present invention that the ball retrieval apparatus 70 could be formed in alternative manners and perform the desired function as described herein. Additionally, while the golf putter 100 has been illustrated having the ball-mark 30 and the ball retrieval apparatus 70, it is contemplated within the scope of the present invention that the golf putter 100 could be manufactured having the ball-mark 30 or the ball retrieval apparatus 70 as described herein only.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A golf putter configured to mark the location of a golf ball on a golf course green and is further configured to retrieve a golf ball comprising:

a shaft, said shaft being cylindrically tapered in shape having a first end and a second end, said shaft being substantially hollow having an interior volume, said shaft having an opening proximate said first end, said shaft further including a cap covering said opening, said cap being releasably secured to said opening;

a head, said head being secured to said second end of said shaft, said head including a body being modified rectangular in shape, said body including a striking surface and a bottom surface, said striking surface and said bottom surface being substantially perpendicular with respect to each other;

a ball marking member, said ball marking member being releasably secured to said bottom surface, said ball marking member being annular in shape and manufactured from a ferromagnetic material, said ball marking member having a first position and a second position, said ball marking member being secured within a recess, said recess being formed within said bottom surface, said recess operable to receive said ball marking member such that the ball marking member is planarly aligned with said bottom surface;

a ball retrieval apparatus, said ball retrieval apparatus being movably mounted within said interior volume of said shaft proximate said first end, said ball retrieval apparatus having four arms, said four arms being manufactured from a resilient metal, said four arms having a first end and a second end, said four arms being joined proximate said first end, said second ends of said four arms being hook-shaped, said ball retrieval apparatus configured to extend outward from said opening so as to facilitate the retrieval of a golf ball.

2. The golf putter as recited in claim 1, and further including a cavity, said cavity disposed within said head, said cavity being generally rectangular in shape, said cavity operable to house a magnet and a first spring, said magnet operable to releasably secure said ball marking member within said recess, said magnet being operated by said first spring, said magnet being slidably mounted within said cavity, said magnet having a first position and a second position, wherein in said first position said magnet is substantially aligned with said recess so as to releasably secure said ball marking device within said recess.

3. The golf putter as recited in claim 2, and further including a first control wire, said first control wire operably coupled to said magnet, said first control wire having a first end and a second end, said second end of said first control wire extending into said interior volume of said shaft, said second end of said first control wire being journaled through a first slot, said second end of said first control wire having a keeper fastened thereto, said keeper being externally located on said shaft, said first slot having a first position and a second position, said keeper configured to be movable between said first position and said second position of said first slot.

4. The golf putter as recited in claim 2, and further including a second spring, said second spring operably coupled to said ball retrieval apparatus, said second spring configured to transition said ball retrieval apparatus between a first position, a second position and a third position.

5. The golf putter as recited in claim 3 and further including a second control wire, said second control wire operably coupled with said ball retrieval apparatus, said second control wire having a first end and a second end, said second end of said second control wire extending through said interior volume of said shaft towards said second end of said shaft.

6. The golf putter as recited in claim 4, and further including a second slot, said second slot being journaled through the wall of said shaft, said second slot operable to receive said second end of said second control wire, said second slot having a first notch, second notch and a third notch.

7. The golf putter as recited in claim 5, and further including a holder, said holder secured to said second end of said second control wire, said holder being external to said shaft, said holder operable to provide and interface to move said second control wire between said first notch, said second notch and said third notch.

* * * * *